US010969082B2

(12) United States Patent
Narita et al.

(10) Patent No.: US 10,969,082 B2
(45) Date of Patent: Apr. 6, 2021

(54) LIGHT EMITTING DEVICE

(71) Applicant: TOKI CORPORATION, Tokyo (JP)

(72) Inventors: Mizue Narita, Tokyo (JP); Daiki Miwa, Tokyo (JP)

(73) Assignee: TOKI CORPORATION, Tokyo (JP)

( * ) Notice: Subject to any disclaimer, the term of this patent is extended or adjusted under 35 U.S.C. 154(b) by 0 days.

(21) Appl. No.: 16/104,541

(22) Filed: Aug. 17, 2018

(65) Prior Publication Data

US 2018/0356072 A1 Dec. 13, 2018

Related U.S. Application Data

(63) Continuation of application No. PCT/JP2017/002794, filed on Jan. 26, 2017.

(30) Foreign Application Priority Data

Feb. 17, 2016 (JP) ..... JP2016-027942

(51) Int. Cl.

| | |
|---|---|
| ***F21K 9/237*** | (2016.01) |
| ***F21K 9/68*** | (2016.01) |
| ***F21K 9/69*** | (2016.01) |
| ***F21V 13/04*** | (2006.01) |
| ***F21V 17/00*** | (2006.01) |
| ***F21K 9/233*** | (2016.01) |

(Continued)

(52) U.S. Cl.

CPC ..... *F21V 13/04* (2013.01); *F21K 9/233* (2016.08); *F21K 9/237* (2016.08); *F21K 9/68* (2016.08); *F21K 9/69* (2016.08); *F21V 7/06* (2013.01); *F21V 17/002* (2013.01); *F21Y 2115/10* (2016.08)

(58) Field of Classification Search

CPC . F21K 9/237; F21K 9/62; F21K 9/233; F21V 17/002; F21V 7/06; F21V 7/66; F21V 7/22

See application file for complete search history.

(56) References Cited

U.S. PATENT DOCUMENTS 6,733,156 B2 * 5/2004 Chen ..... H01L 33/60 257/E25.02

7,520,641 B2 4/2009 Minano et al.

(Continued)

FOREIGN PATENT DOCUMENTS

| | | |
|---|---|---|
| EP | 1113506 | 7/2001 |
| JP | 2001-217466 | 8/2001 |

(Continued)

OTHER PUBLICATIONS

International Search Report on corresponding PCT international application No. PCT/JP2017/002794, dated Apr. 11, 2017.

(Continued)

*Primary Examiner* — Alexander K Garlen
*Assistant Examiner* — Eric T Eide

(57) ABSTRACT

A light emitting device includes: an LED; a reflecting mirror that reflects light emitted by the LED and radiates the light outside and has a reflecting surface shaped in a paraboloid of revolution; and a light absorptive material that, of the light emitted by the LED, blocks the light beyond a 1/4 beam angle θ from being incident on the reflecting mirror. The LED is provided at a position displaced from a focal point of the paraboloid of revolution.

6 Claims, 7 Drawing Sheets

(51) Int. Cl.
*F21Y 115/10* (2016.01)
*F21V 7/06* (2006.01)

(56) References Cited

U.S. PATENT DOCUMENTS

| | | | | |
|---|---|---|---|---|
| 9,109,781 | B2 | 8/2015 | Holder | |
| 2001/0024087 | A1 | 9/2001 | Suehiro et al. | |
| 2003/0016536 | A1* | 1/2003 | Lin | F21S 9/022 362/249.02 |
| 2005/0168994 | A1* | 8/2005 | Jacobson | F21K 9/00 362/294 |
| 2006/0164836 | A1* | 7/2006 | Suehiro | F21K 9/00 362/294 |
| 2010/0102199 | A1* | 4/2010 | Negley | F21V 7/0008 250/201.1 |
| 2010/0264797 | A1* | 10/2010 | Wang | F21V 7/0008 313/46 |
| 2012/0195042 | A1* | 8/2012 | Chu | F21V 7/0008 362/249.02 |
| 2014/0063779 | A1* | 3/2014 | Bradford | F21V 23/0442 362/84 |
| 2014/0103373 | A1* | 4/2014 | Li | H01L 33/502 257/88 |

FOREIGN PATENT DOCUMENTS

| | | |
|---|---|---|
| JP | 2004-354495 | 12/2004 |
| JP | 2005-243608 | 9/2005 |
| JP | 2010-44956 | 2/2010 |
| JP | 2011-521460 | 7/2011 |
| JP | 2012-226874 | 11/2012 |

OTHER PUBLICATIONS

International Preliminary Report on Patentability on corresponding PCT international application No. PCT/JP2017/002794, dated Aug. 21, 2018.

Office Action on corresponding JP application No. 2016-027942, dated Aug. 20, 2019.

Espacenet, English Translation of Abstract for JP 2011-521460, Jul. 21, 2011.

Espacenet, English Translation of Abstract for JP 2005-243608, Sep. 8, 2005.

Office Action on corresponding JP application No. 2016-027942, dated Jan. 21, 2020.

* cited by examiner

LIGHT EMITTING DEVICE

BACKGROUND OF THE INVENTION

1. Field of the Invention

The present invention relates to light emitting devices and, more particularly, to a light emitting device in which an LED is used.

2. Description of the Related Art

Light emitting devices configured to reflect light from an LED to create a spot light in front have been known in the art (see, for example, patent document 1).

[patent document 1] JP2012-226874

Currently, a common method to produce a white light is to use blue light emission from a blue LED chip and excite a yellow light emitting body by using a portion of the blue light to emit light, thereby producing a white light as a mixture of the blue light and the yellow light. However, the related-art method has a problem in that color unevenness occurs easily. This is because of uneven amount of phosphor relative to the light emission from the LED chip. A white light is readily produced in the front direction in which the intensity of light emitted from the LED chip is sufficient. Meanwhile, a yellow light is readily produced in the wide-angle direction in which the intensity of light emitted from the LED chip is weak. For this reason, color unevenness occurs easily in creating a spot light using an LED. For example, a white light is produced in a bright portion at the center of the spot light and a yellow light is produced in a relatively dark portion at the fringe.

Most of related-art light emitting devices for creating a spot light of a narrow angle (e.g., 5°) realize narrow-angle light emission merely by focusing the light emitted from the LED by using a lens. In such light emitting devices, the yellow light from the LED is also focused by the lens to form a spot light so that color unevenness is quite noticeable.

SUMMARY OF THE INVENTION

The embodiments address the above-described issue, and a general purpose thereof is to provide a light emitting device capable of producing a narrow-angle circular spot light in which color unevenness is suppressed.

A light emitting device according to an embodiment of the present invention includes: a light emitting unit; a reflecting mirror that reflects light emitted by the light emitting unit and radiates the light outside and has a reflecting surface shaped in a paraboloid of revolution; and a light blocking unit that, of the light emitted by the light emitting unit, blocks the light beyond a predetermined beam angle from being incident on the reflecting mirror. The light emitting unit is provided at a position displaced from a focal point of the paraboloid of revolution.

The predetermined beam angle may be a beam angle between a ½ beam angle and a ¼ beam angle of the light emitting unit.

The light blocking unit may be made of a light absorptive material that absorbs the light beyond the predetermined beam angle.

The light emitting unit may include an LED and a lens provided between the LED and the reflecting mirror.

The reflecting surface may be configured as a polyhedron.

The light emitting device may further include: a casing that supports the light emitting unit; and a reflecting mirror support member that supports the reflecting mirror. The reflecting mirror support member may include a metal base for power feeding.

The reflecting mirror support member may be replaceably attached to the casing.

Optional combinations of the aforementioned constituting elements, and implementations of the invention in the form of apparatuses, methods, and systems may also be practiced as additional modes of the present invention.

BRIEF DESCRIPTION OF THE DRAWINGS

Embodiments will now be described by way of examples only, with reference to the accompanying drawings which are meant to be exemplary, not limiting and wherein like elements are numbered alike in several Figures in which.

DETAILED DESCRIPTION OF THE INVENTION

The invention will now be described by reference to the preferred embodiments. This does not intend to limit the scope of the present invention, but to exemplify the invention.

Figure 1:
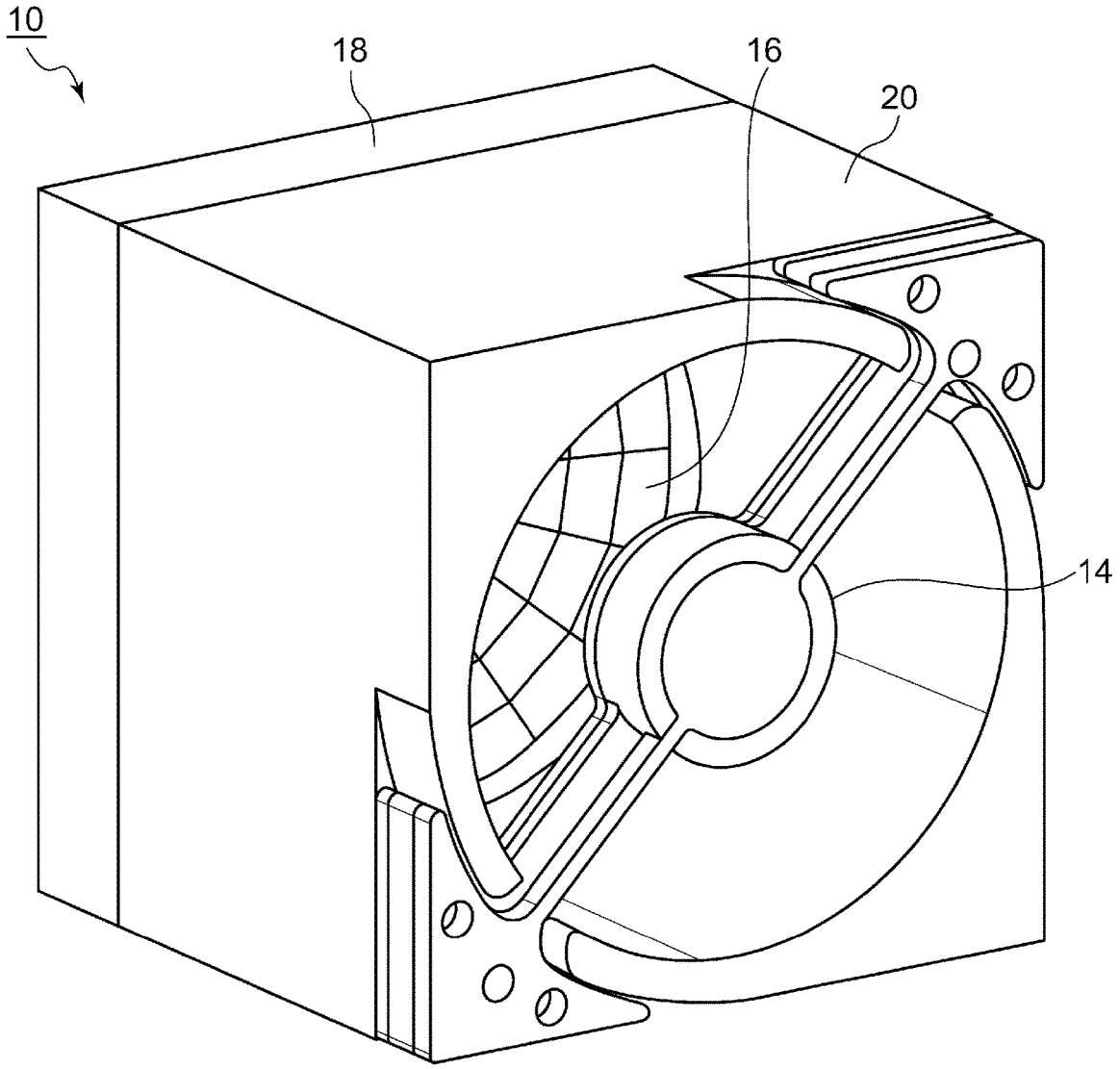
FIG. 1 is a perspective view of a light emitting device according an embodiment of the present invention.
Figure 2:
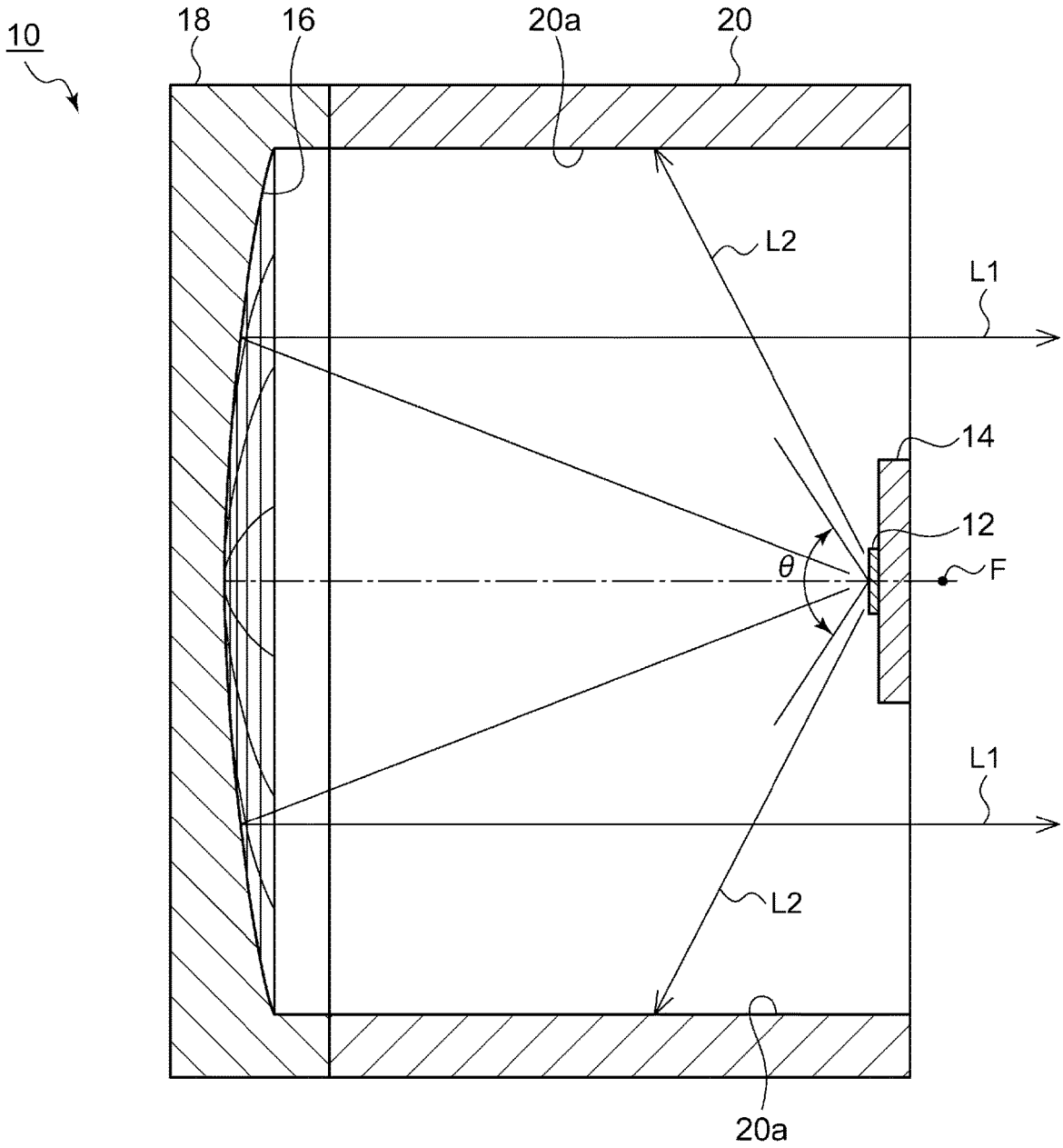
FIG. 2 is a cross-sectional view of the light emitting device according to the embodiment of the present invention.

FIG. 1 is a perspective view of a light emitting device 10 according an embodiment of the present invention. FIG. 2 is a cross-sectional view of the light emitting device 10 according to the embodiment of the present invention. The light emitting device 10 according to the embodiment is provided with an LED 12 as a light emitting unit, an LED mount 14 on which the LED is mounted, a reflecting mirror 16, a reflecting mirror support member 18 for supporting the reflecting mirror 16, and a casing 20 for supporting the LED 12 and the LED mount 14.

The LED 12 may emit a white light. The LED 12 may be provided with a blue LED chip and a yellow light emitting body. By using blue light emission from the blue LED chip and exciting a yellow phosphor by using a portion of the blue light to emit light, a white light is produced as a mixture of the blue light and the yellow light.

The reflecting mirror 16 may have a reflecting surface shaped in a paraboloid of revolution. As indicated by a light ray L1 of FIG. 2, the reflecting mirror 16 reflects the light emitted by the LED 12 to radiate the light outside the casing 20. The light reflected by the reflecting mirror 16 forms a narrow-angle circular spot light in front of the light emitting device 10.

As shown in FIG. 2, the LED 12 is provided at a position displaced from the focal point F of the paraboloid of revolution. The amount of displacement from the focal point F may be ±0.2 mm-0.3 mm. When the LED 12 is located at the focal point F of the paraboloid of revolution, the light reflected by the reflecting mirror 16 is turned into a completely parallel light so that an image of the LED 12 may be formed on a plane irradiated with the spot light. By locating the LED 12 at a position displaced from the focal point F of the paraboloid of revolution, the parallel light is disturbed so that an image of the LED 12 is prevented from being formed on a plane irradiated with the spot light and a clean irradiated plane can be formed.

The light emitting device 10 according to the embodiment is configured such that, of the light emitted by the LED 12, the light beyond the ¼ beam angle θ is not incident on the reflecting mirror 16. As shown in FIG. 2, the light L2 beyond the ¼ beam angle θ is not incident on the reflecting mirror 16 and is incident on an inner wall surface 20*a* of the casing 20. The ¼ beam angle is an angle in which the light intensity drops to ¼ with reference to maximum light intensity. The inner wall surface 20*a* of the casing 20 is coated with a light absorptive material as a light blocking unit. The light L2 beyond the ¼ beam angle θ is absorbed and blocked by the light absorptive material and so is not incident on the reflecting mirror 16. Accordingly, the light L2 beyond the ¼ beam angle θ is not emitted outside the casing 20 and does not contribute to formation of a spot light. The light absorptive material may be produced by turning a blue pigment into a paint by using an acrylic resin or implemented by a black resin itself.

As mentioned above, an attempt to produce a white light as a mixture of a blue light and a yellow light is likely to result in color unevenness, in which a white light is produced in a bright portion at the center and a yellow light is produced in a relatively dark portion at the fringe. In particular, we have found that a yellow light is rich in the light beyond the ¼ beam angle in commonly-used LEDs. Thus, by blocking the yellow light beyond the ¼ beam angle from being incident on the reflecting mirror 16, a clean light in which color unevenness is suppressed is produced.

Figure 3:
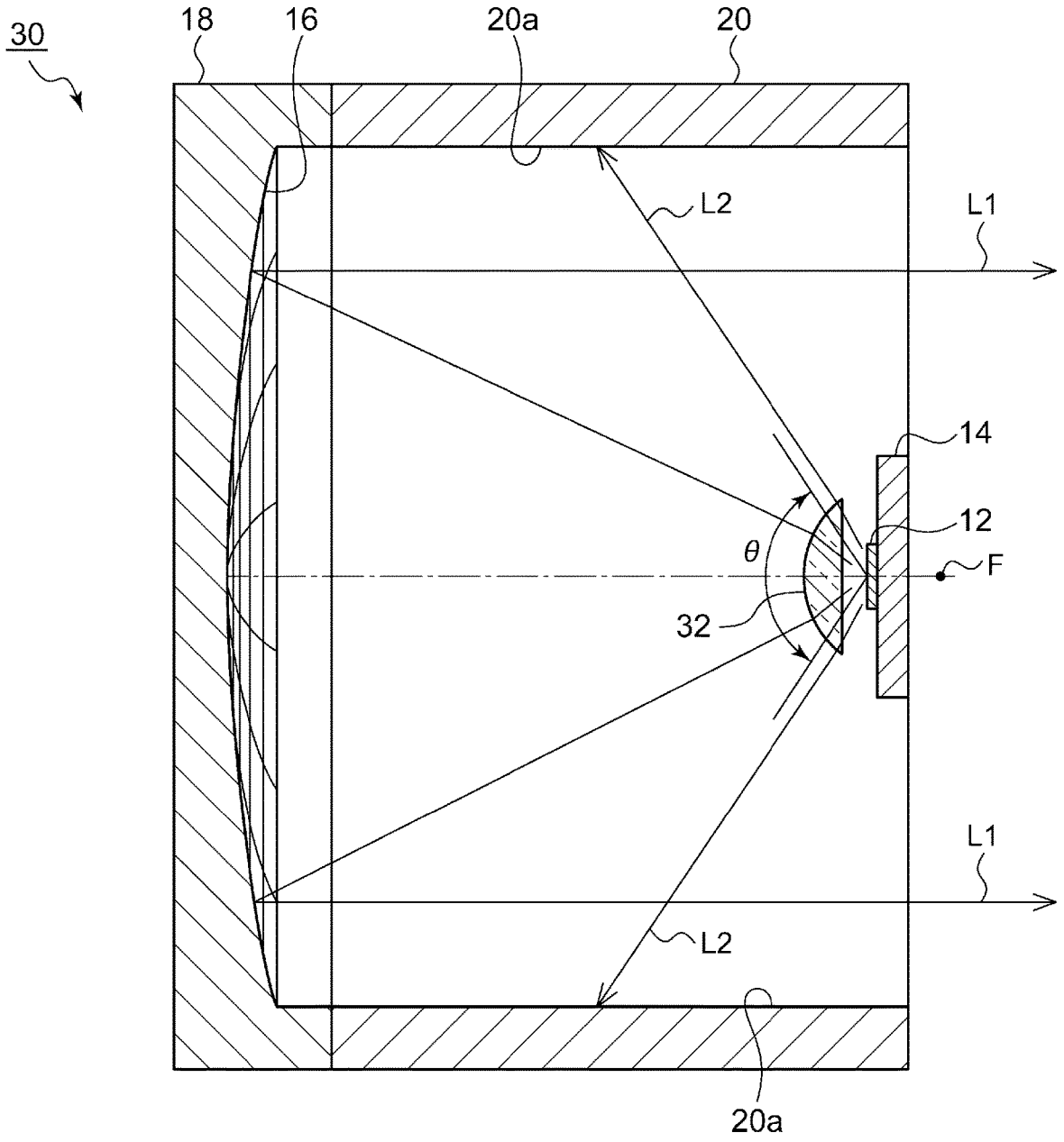
FIG. 3 is a cross-sectional view illustrating a variation of the light emitting device.

FIG. 3 is a cross-sectional view illustrating a variation of the light emitting device. A light emitting device 30 according to this variation is provided with a light emitting unit including the LED 12 and a lens 32 provided between the LED 12 and the reflecting mirror 16. Providing the lens 32 ensures that the light from the LED 12 is incident on the reflecting mirror 16 efficiently and improves the efficiency of using light. It is also ensured in this variation that the light L2 beyond the ¼ beam angle θ is absorbed by the light absorptive material coating on the inner wall surface 20*a* of the casing 20 and is not incident on the reflecting mirror 16. Accordingly, a clean light in which color unevenness is suppressed is produced.

In the embodiment described above, the light emitting device is configured such that, of the light emitted by the LED 12, the light beyond the ¼ beam angle is not incident on the reflecting mirror 16. The threshold beyond which color unevenness is noticeable varies depending on the type of LED. Accordingly, the light emitting device may be configured such that, of the light emitted by the LED, the light beyond a predetermined beam angle is not incident on the reflecting mirror. The predetermined beam angle may be determined as appropriate through experiments or simulation depending on the LED used. For example, the light emitting device may be configured such that the light beyond the ½ beam angle through the ¼ beam angle is not incident on the reflecting mirror 16.

Figure 4C:
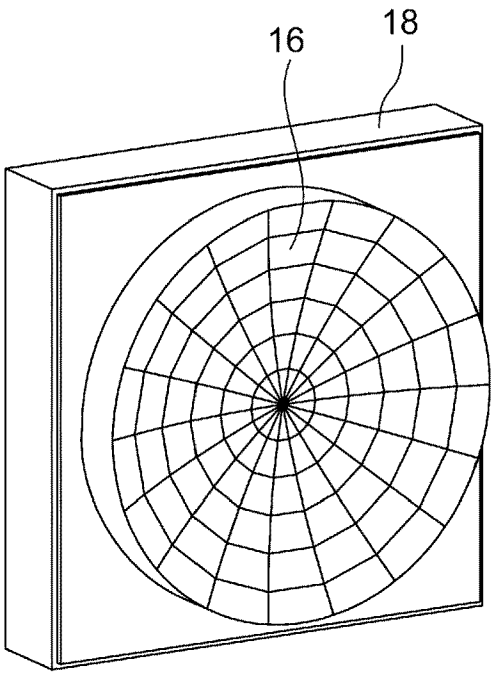
FIGS. 4A-4C show variations of the reflecting mirror.
Figure 4B:
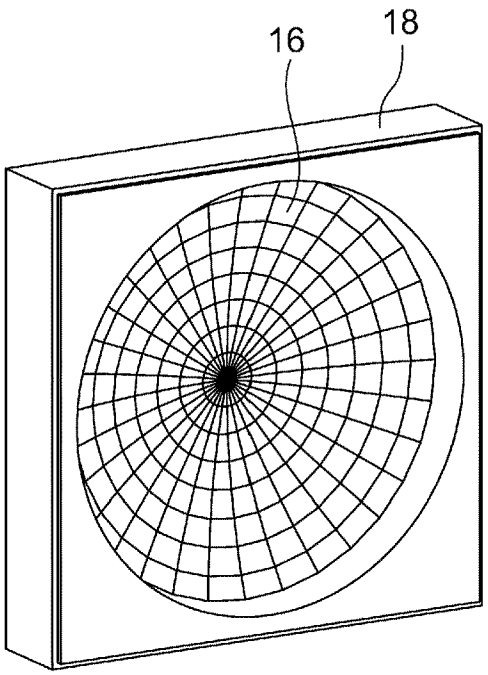
Figure 4A:
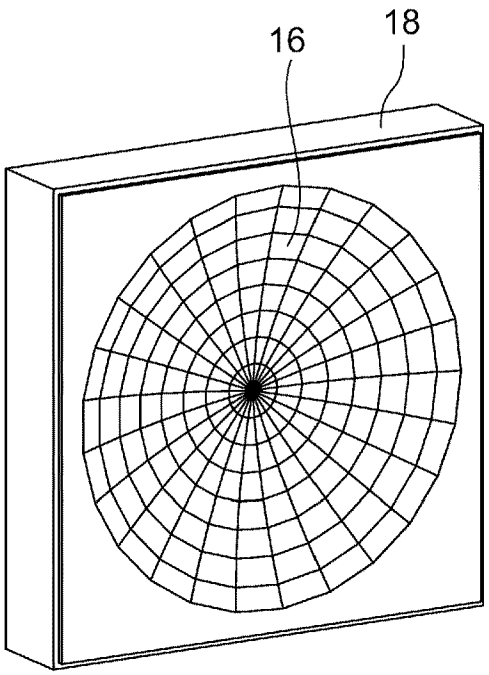

FIGS. 4A-4C show variations of the reflecting mirror 16. In these embodiments, the reflecting surface of the reflecting mirror 16 is configured as a polyhedron. In other words, the reflecting surface of the reflecting mirror 16 is not formed to have a continuously curved surface but is formed by connecting a plurality of planar reflecting surfaces. When the reflecting mirror 16 is formed to have a continuously curved surface, an image of the LED 12 may be formed on a plane irradiated with the spot light. By configuring the reflecting surface of the reflecting mirror 16 as a polyhedron as in this embodiment, the parallel light is disturbed so that an image of the LED 12 is prevented from being formed on a plane irradiated with the spot light and a clean irradiated plane can be formed.

In accordance with the embodiment, light distribution can be adjusted by adjusting the number of faces of the polyhedron of the reflecting mirror 16. If the number of faces of the polyhedron is increased (i.e., if the size of each planar reflecting surface is reduced) as shown in FIG. 4A, the reflecting mirror 16 will approximate the shape of a paraboloid of revolution so that the irradiation angle will be smaller. Conversely, if the number of faces of the polyhedron is decreased (i.e., if the size of each planar reflecting surface is enlarged) as shown in FIG. 4B, the irradiation angle will be greater.

In commonly-used light emitting devices, a blast treatment is sometimes applied to the reflecting surface for the purpose of producing disturbance in the parallel light from the reflecting mirror. In this case, however, the light may be scattered, and the amount of light retrieved may be lowered. Meanwhile, the reflecting surface of the embodiment is configured as a polyhedron so that, in comparison with the case of applying a blast treatment on the reflecting surface, the light is less scattered, and, accordingly, disturbance is produced in the parallel light while at the same time a decrease in the amount of light is suppressed.

The reflecting mirror 16 shown in FIG. 4C differs from that of FIG. 4A in terms of the position relative to the reflecting mirror support member 18. In other words, the reflecting mirror 16 of FIG. 4C is provided at an elevated position with reference to the reflecting mirror support member 18. When the reflecting mirror 16 is provided at an elevated position as shown in FIG. 4C, the LED 12 will be displaced from the focal point of the reflecting surface shaped in a paraboloid of revolution. Accordingly, an irradiation angle is increased. Adjustment of light distribution is also possible by adjusting the height of the reflecting mirror 16 in this way.

In this embodiment, the reflecting mirror support member 18 for supporting the reflecting mirror 16 is replaceably attached to the casing 20. For example, the casing 20 and the reflecting mirror support member 18 may be attached by a magnet (not shown) or attached by using a double-sided adhesive tape or a screw. By preparing reflecting mirror support members 18 provided with a variety of reflecting mirrors 16 that differ in the number of faces of the polyhedron, the position relative to the reflecting mirror support member 18, the curvature of the paraboloid of revolution, etc., and replacing the reflecting mirror support member 18 depending on the usage, light distribution can be changed easily by, for example, changing from a narrow-angle (e.g., 5°) spot light to a wide-angle (e.g., 20°) spot light.

Figure 5:
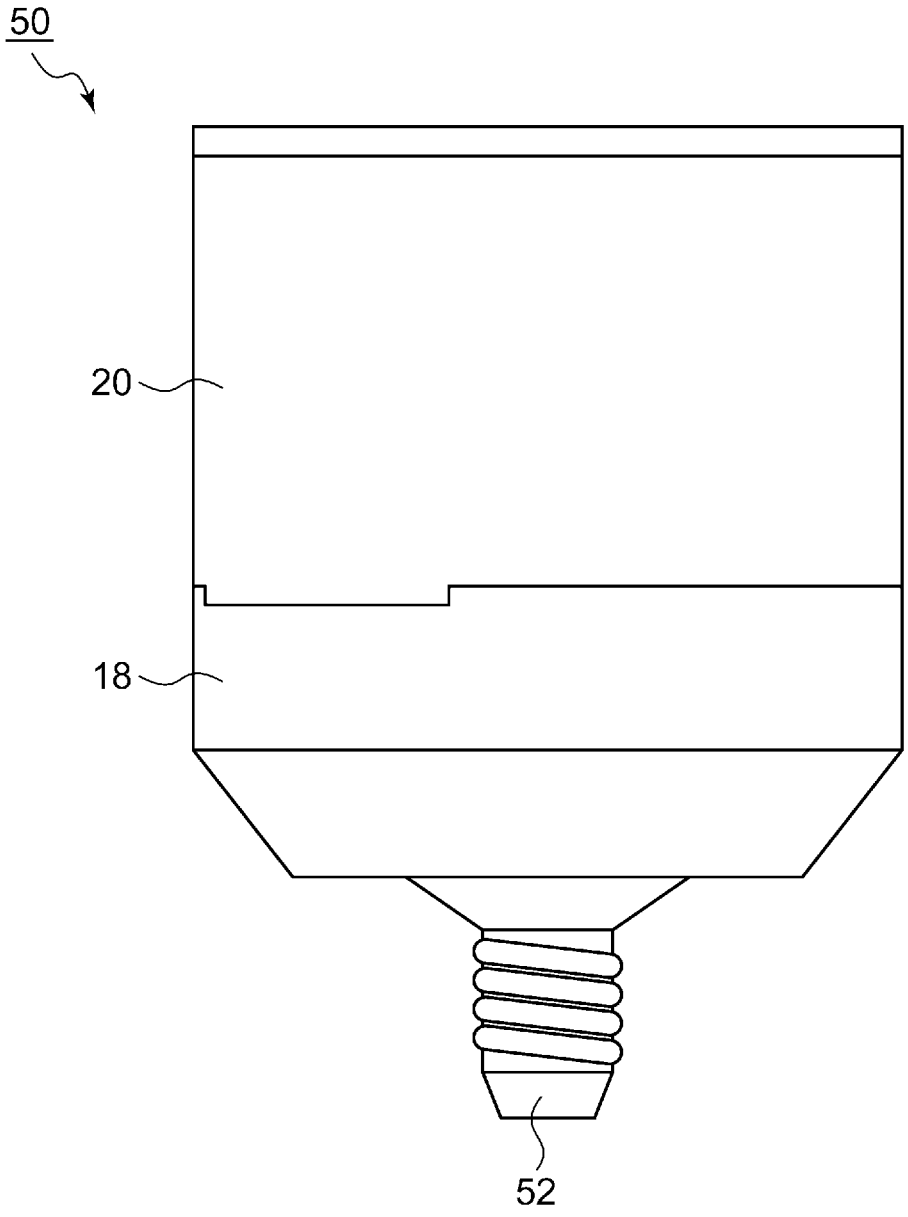
FIG. 5 is a side view illustrating another variation of the light emitting device.

FIG. 5 is a side view illustrating another variation of the light emitting device. In a light emitting device 50 according to this variation, the reflecting mirror support member 18 is provided with a metal base 52 for feeding power. By providing the metal base 52 in this way, the light emitting device 50 can be mounted to existent lighting devices.

Figure 6:
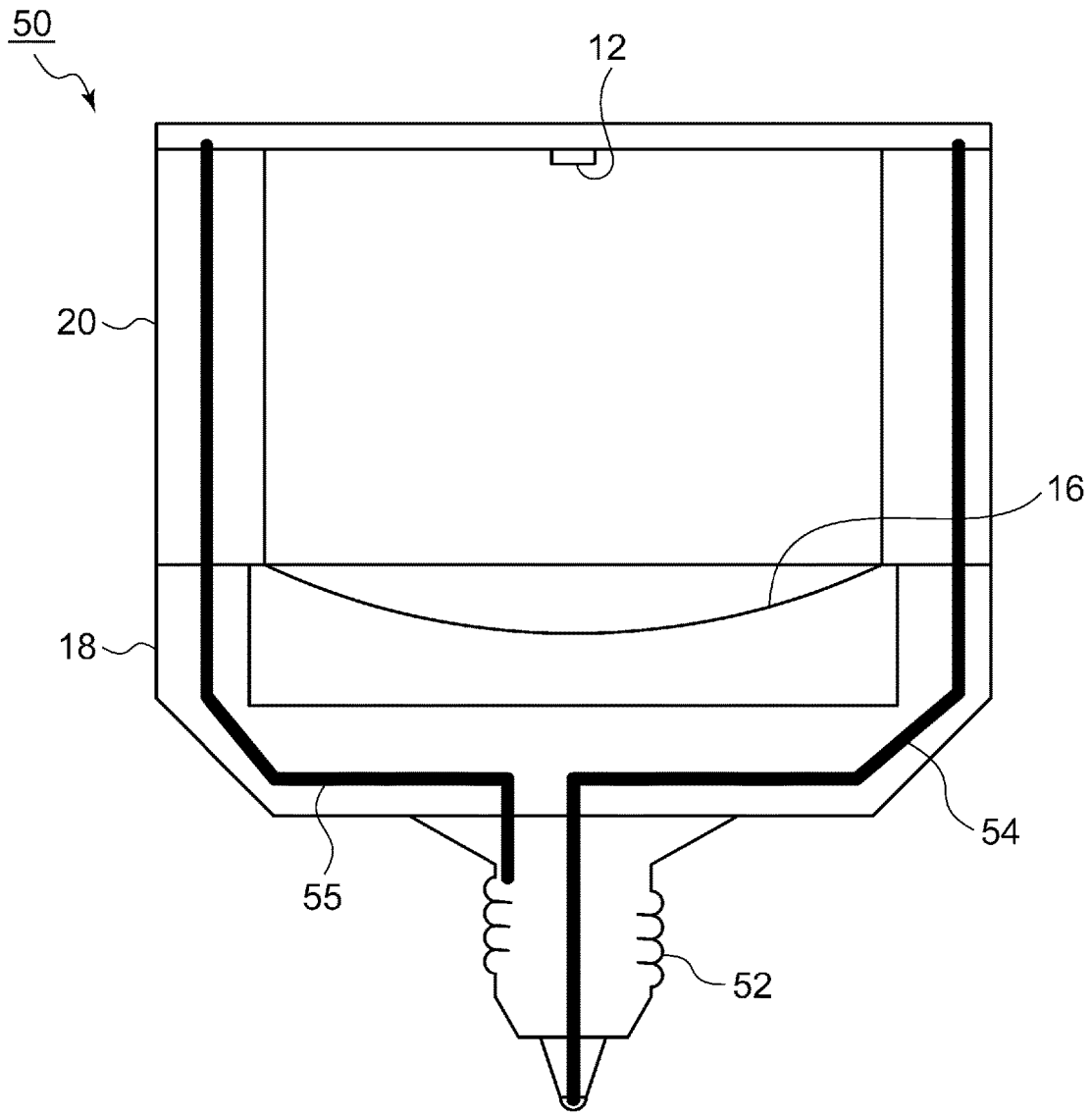
FIG. 6 is a schematic cross-sectional view of the light emitting device shown in FIG. 5.

FIG. 6 is a schematic cross-sectional view of the light emitting device 50 shown in FIG. 5. As shown in FIG. 5, the light emitting device 50 is provided with wirings 54, 55 inside the reflecting mirror support member 18 and the casing 20. By providing the wirings 54, 55 in this way, it is possible to supply the LED 12 with power fed to the metal base 52 from the lighting device.

Figure 7B:
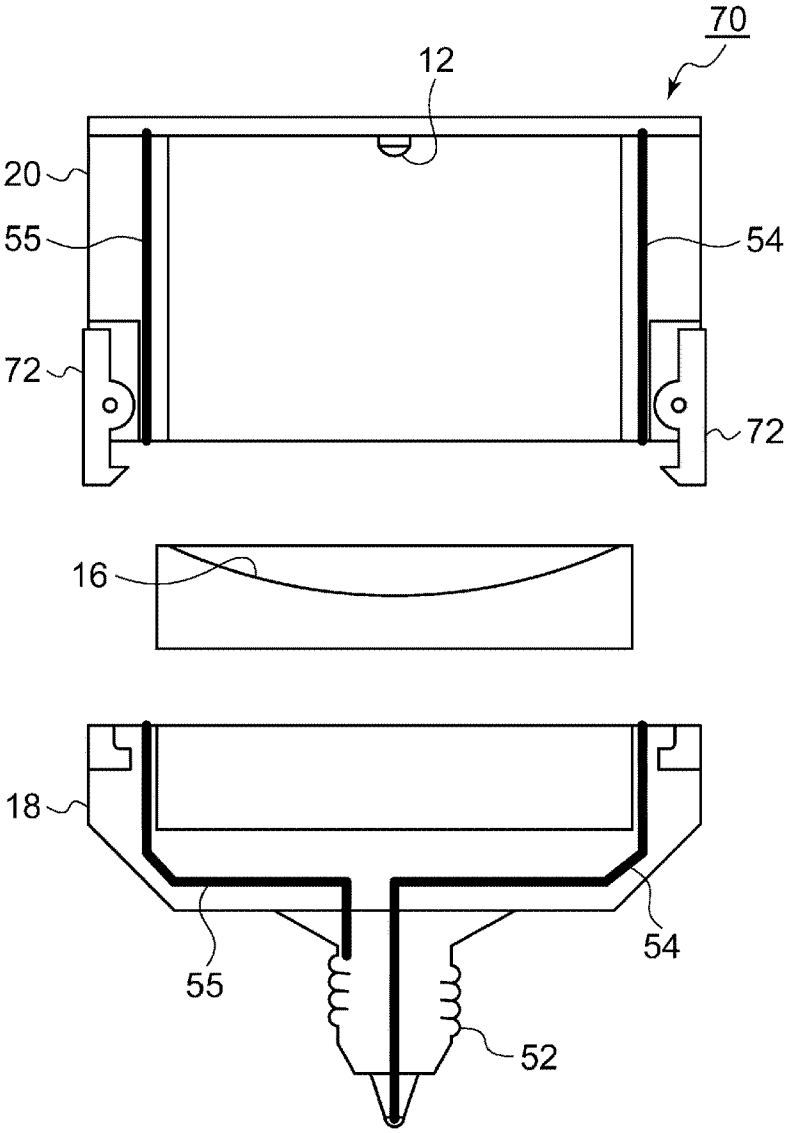
FIGS. 7A and 7B are schematic diagrams illustrating still another variation of the light emitting device.
Figure 7A:
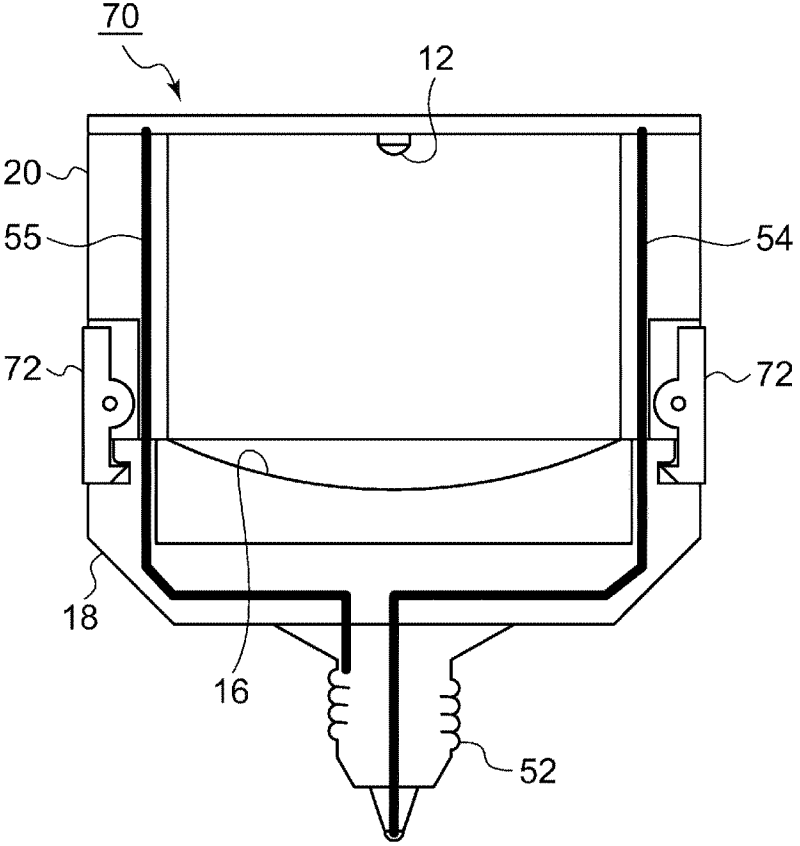

FIGS. 7A and 7B are schematic diagrams illustrating still another variation of the light emitting device. A light emitting device 70 according to this variation is provided with a fixing part 72 for fixing the casing 20 and the reflecting mirror support member 18.

Further, in the light emitting device 70 according to this variation, the reflecting mirror 16 is removable from the reflecting mirror support member 18 as shown in FIG. 7B. By configuring the reflecting mirror 16 to be removable from the reflecting mirror support member 18, it is possible to prepare a plurality of reflecting mirrors 16 at a lower cost than when the reflecting mirror support member 18 and the reflecting mirror 16 are integrally formed.

Described above is an explanation based on an exemplary embodiment. The embodiment is intended to be illustrative only and it will be obvious to those skilled in the art that various modifications to constituting elements could be developed and that such modifications are also within the scope of the present invention.

What is claimed is:

1. A light emitting device comprising:

an LED including a blue LED chip and a yellow light emitting body and producing a white light as a mixture of a blue light and a yellow light;

a reflecting mirror that reflects the white light emitted by the LED and radiates the white light outside and has a reflecting surface shaped in a substantially paraboloidal shape;

a light absorptive material that, of the white light emitted by the LED, absorbs the white light outside of predetermined beam angle that is selected between a ½ beam angle and a ¼ beam angle of the LED to block the white light from being incident on the reflecting mirror, wherein the LED is provided at a position displaced from a focal point of the paraboloid of revolution.

2. The light emitting device according to claim 1, further comprising:

a casing that supports the LED, wherein the inner wall surface of the casing is coated with the light absorptive material.

3. The light emitting device according to any one of claim 1, further comprising:

a lens provided between the LED and the reflecting mirror.

4. The light emitting device according to claim 1, wherein the reflecting surface is configured as a polyhedron.

5. The light emitting device according to any one of claim 1, further comprising:

a casing that supports the LED; and a reflecting mirror support member that supports the reflecting mirror, wherein the reflecting mirror support member includes a metal base for power feeding.

6. The light emitting device according to claim 5, wherein the reflecting mirror support member is replaceably attached to the casing.

* * * * *